US007163494B2

(12) United States Patent
Panatta

(10) Patent No.: US 7,163,494 B2
(45) Date of Patent: Jan. 16, 2007

(54) GYMNASTIC APPARATUS

(75) Inventor: Rodolfo Panatta, Apiro (IT)

(73) Assignee: Panatta Sport S.R.L., Apiro (IT)

( * ) Notice: Subject to any disclaimer, the term of this patent is extended or adjusted under 35 U.S.C. 154(b) by 564 days.

(21) Appl. No.: 10/458,208

(22) Filed: Jun. 10, 2003

(65) Prior Publication Data

US 2004/0005964 A1 Jan. 8, 2004

(30) Foreign Application Priority Data

Jun. 12, 2002 (IT) ..... BO2002A0372

(51) Int. Cl.
*A63B 21/062* (2006.01)
*A63B 21/00* (2006.01)

(52) U.S. Cl. ..... 482/99; 482/135

(58) Field of Classification Search ..... 482/99–103, 482/137–138, 79–80, 139, 908
See application file for complete search history.

(56) References Cited

U.S. PATENT DOCUMENTS 4,491,314 A * 1/1985 Belyavsky et al. ..... 482/42
4,711,448 A * 12/1987 Minkow et al. ..... 482/100
4,957,281 A * 9/1990 Christolear, Jr. ..... 482/100
5,062,633 A * 11/1991 Engel et al. ..... 482/118
5,147,259 A * 9/1992 Hutchins ..... 482/101
5,413,517 A * 5/1995 Kamijima ..... 446/354
5,749,668 A * 5/1998 McIlvain et al. ..... 482/79
6,267,709 B1 * 7/2001 Jacques et al. ..... 482/8

OTHER PUBLICATIONS

Henry T. Brown, 507 Mechanical Movements, 1901, Brown & Seward . pp. 12-15.*

* cited by examiner

*Primary Examiner*—Jerome Donnelly
*Assistant Examiner*—Fenn C. Mathew
(74) *Attorney, Agent, or Firm*—Armstrong, Kratz, Quintos, Hanson & Brooks, LLP

(57) ABSTRACT

A gymnastic apparatus is provided with a base (2), which is used to place the gymnastic apparatus on the ground, at least a user-operated actuator (22) that can be moved from initial to final position; a weight unit (8) used to normally maintain the actuator (22) in initial position; and driving means (33) used to connect the actuator (22) and weight unit (8) and provided with at least a cam (38) housed inside a box-shaped section of the base (2).

8 Claims, 3 Drawing Sheets

GYMNASTIC APPARATUS

The present invention refers to a gymnastic apparatus.

In particular, the present invention refers to a gymnastic apparatus used to train anterior thigh muscles, commonly defined as "leg extension apparatus"; the following description continues with reference to the aforementioned term, without losing its general character.

In the field of gymnastic apparatuses, a leg extension apparatus comprises a user-operated actuator composed of a shaft fitted to oscillate around its basically horizontal longitudinal axis, a support arm that extends transversally to the shaft and fitted to the shaft in fixed angular position during use and a padded roll that projects from the support arm parallel to the shaft and oscillates around the axis from initial to final position.

A leg extension apparatus also comprises a weight unit used to normally maintain the actuator and the padded roll in initial position; and driving means used to connect the actuator and weight unit, comprising at least one cam fitted to the shaft in coaxial position to the axis and connected to the weight unit by means of at least one traction cable.

Since the cam is fitted to the actuator shaft in coaxial position, the cam and traction cable are placed in user-accessible positions. For this reason, the known leg extension apparatus as illustrated above has relatively reduced ergonomics and high volumes.

The purpose of the present invention is to obtain a gymnastic apparatus without the aforementioned drawbacks.

The present invention provides for a gymnastic apparatus comprising a base used to place the gymnastic apparatus on the ground; an actuating device provided with at least a user-operated actuator that can be moved from initial to final position; a weight unit used to normally maintain the actuator in initial position; and driving means used to connect the actuator and weight unit and provided with at least a cam; and characterised in that the base comprises at least a box-shaped section; the cam being housed inside the box-shaped section of the base.

The description of the invention continues with reference to the enclosed drawings of a non-restrictive embodiment, whereby:

Figure 1:
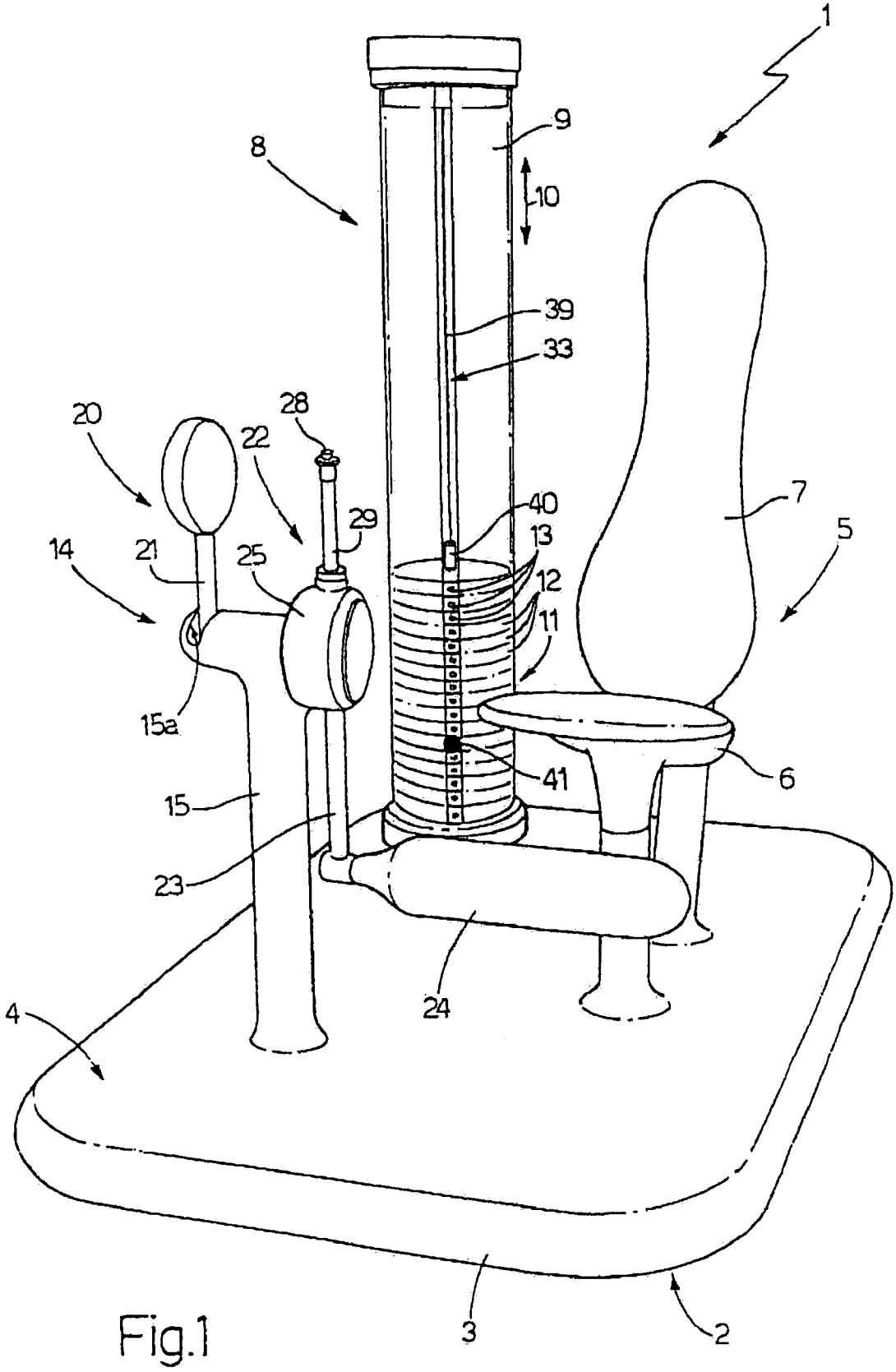
FIG. 1 is a diagrammatic perspective view of a preferred embodiment of the gymnastic apparatus of the invention.

With reference to FIG. 1, number 1 indicates a gymnastic apparatus for anterior thigh muscles, referred to in the following description as "leg extension apparatus".

The leg extension apparatus 1 is provided with a base 2, which is used to place the leg extension apparatus 1 on the ground, and comprises a box-shaped body 3 with basically parallelepiped shape and rounded corners, limited on top by a basically level horizontal surface 4.

The leg extension apparatus 1 also comprises a support device 5 for the user, provided with a seat 6 and a backrest 7 that extend upwards from surface 4; and a weight unit 8 comprising a tubular column 9, which extends upwards from surface 4 in a basically vertical orthogonal direction 10 to surface 4, with basically elliptical transversal cross-section, capable of housing a stack 11 of basically elliptical plates 12, placed one on top of the other in direction 10, matched to the column 9 and provided with a hole 13 through the plate 12 transversally to direction 10.

Figure 2:
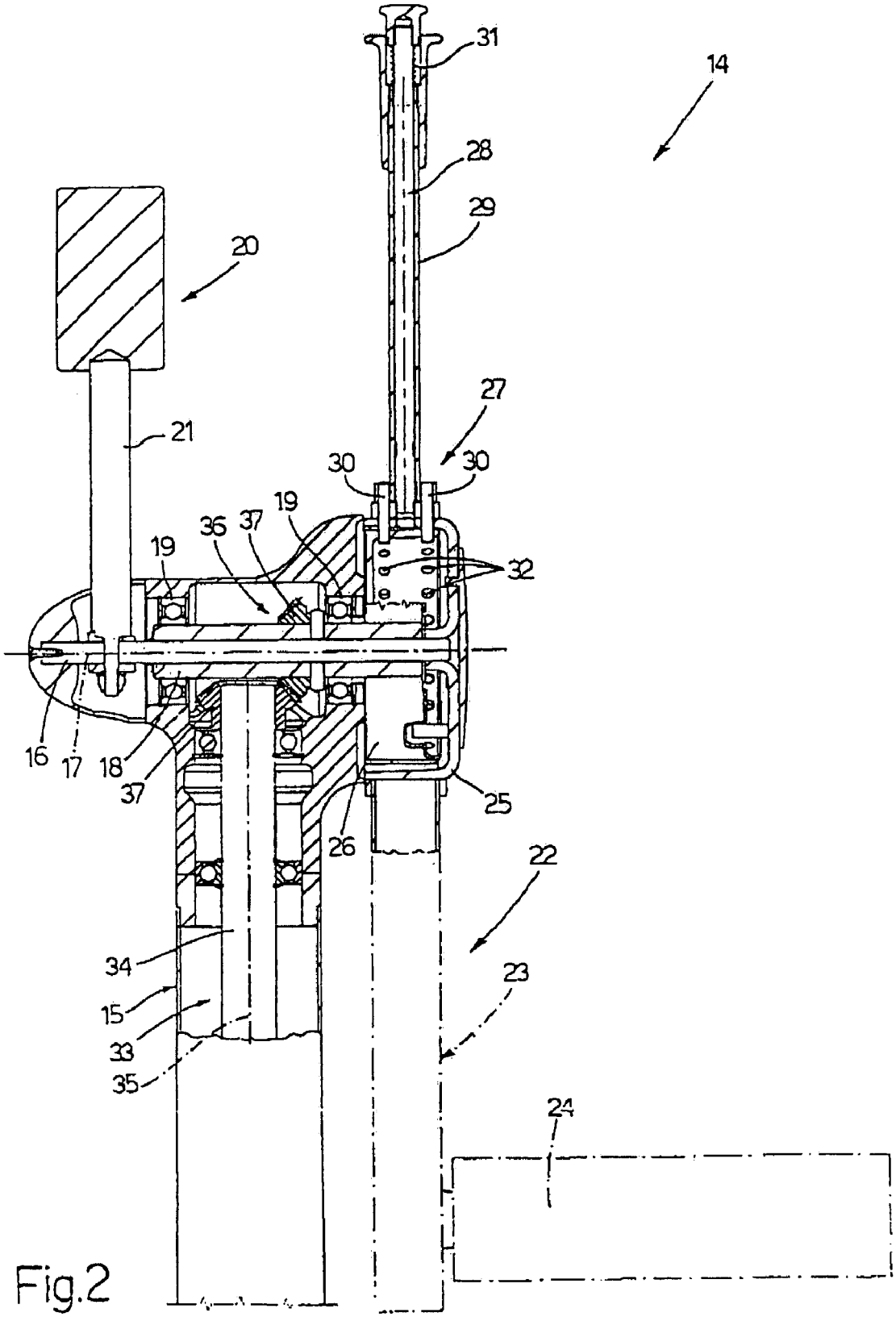
FIG. 2 is a diagrammatic side view, with cross-sectioned parts and removed parts, of a detail of FIG. 1.

With reference to FIGS. 1 and 2, the weight unit 8 is actuated by the user by means of an actuator device 14 comprising a support tubular column 15 that extends upwards form surface 4 in direction 10; and a shaft 16 with a basically horizontal longitudinal axis 17 parallel to surface 4 that engages in fixed angular axial position a metal tube 18 coaxial to axis 17 and is fitted to column 15 by means of two bearings 19 located between the metal tube 18 and the column 15.

The device 14 also comprises a counterweight 20 of known type, provided with a support arm 21, which projects in radial position outwards from axis 17, engages a slot 15*a* through the column 15 and is splined to the shaft 16 to oscillate around the axis 17 during use; and a user-operated actuator 22.

The actuator 22 comprises a support arm 23 provided with a padded roll 24 that projects from the arm 23 parallel to axis 17 and projects in radial position outwards from a central hub 25, extending around a cylindrical bushing 26 fitted to the metal tube 18 in coaxial position to axis 17, fitted to bushing 26 with possibility of rotation and axial movement and blocked in angular position on the bushing 26 by means of a hooking device 27 that allows for adjusting the initial lowered position of the actuator 22 around the axis 17 (FIG. 1).

The device 27 comprises a cylindrical rod 28 that projects in radial position outwards from the bushing 26 and a metal tube 29, which is fitted onto the rod 28, with two hooking pins 30 projecting downwards from the metal tube 29 and normally maintained in lowered hooking position by a spring 31 located between the rod 28 and the metal tube 29, in which each pin 30 engages a hole 32 of a series of multiple holes 32 located in radial position through the bushing 26 and uniformly distributed around the axis 17.

The shaft 16 and the actuator 22 are connected to the weight unit 8 by means of a driving device 33 comprising a shaft 34 with longitudinal axis 35 parallel to direction 10 and perpendicular to axis 17 that extends through the base 2 and inside the column 15 with possibility of rotation and is fitted to the shaft 16 through a gear 36 defined by two toothed conical wheels splined to the shaft 16 and the shaft 34, respectively.

According to embodiments not shown in the enclosed figures, the gear 36 is defined by toothed elements other than the toothed conical wheels shown in FIG. 2 and used to connect shafts with perpendicular or transversal axes.

In case of skew axes 17 and 35, the gear 36 is defined, for instance, by a worm screw and a toothed wheel.

Figure 3:
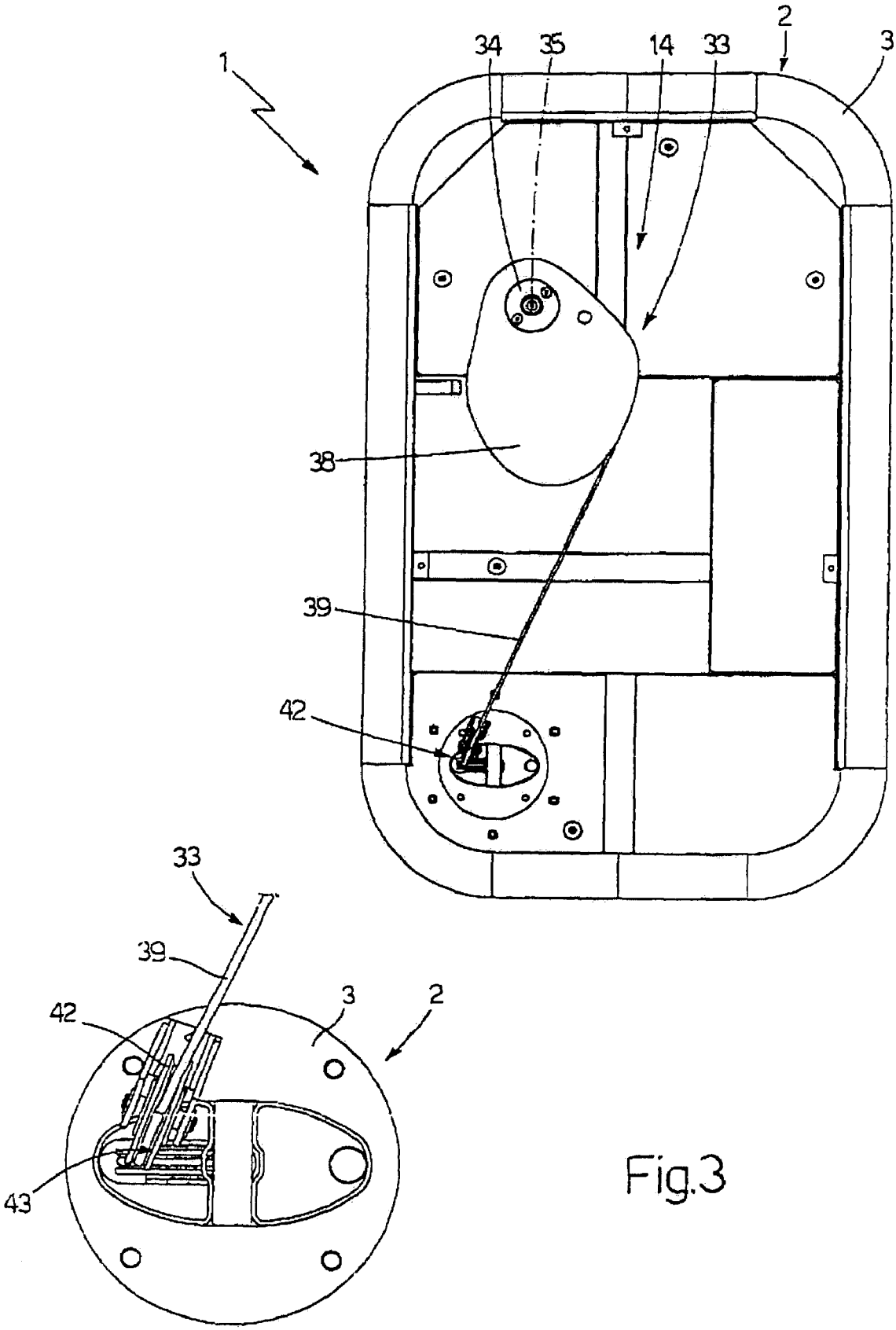
FIG. 3 is a diagrammatic bottom view, with enlarged parts and removed parts, of the gymnastic apparatus of FIG. 1.

With reference to FIG. 3, the device 33 comprises at least a cam 38 splined on the lower free end of the shaft 34, housed inside the box-shaped body 3 and connected by means of at least one traction cable 39 of known type to a rod 40, which is part of an actuator device 14, fitted to the plates 12 and axially blocked to one of the plates 12 by means of a locking pin 41.

With reference to the above, it must be noted that the cable 39 is wound around multiple pulleys 42, with one of the pulleys housed inside the box-shaped body 3 and provided with a guide groove 43 engaged by the cable 39, having a width higher than the thickness of the cable 39 in order for the cable 39 to be directed inside the groove 43 according to the angular position of the cam 38 around the axis 35.

The user is seated on the support device 5, that is to say seat 6 and backrest 7, and actuates the hooking device 27 and the actuator 22 to select the initial lowered position of the actuator 22 around the axis 17.

The user moves the metal tube 29 against the action of the spring 31 to a raised release position, in which the pins 30 disengage from the holes 32; then moves the assembly composed of the actuator 22 and hooking device 27 around the axis 17; and finally releases the metal tube 29 to bring the pins 30 back to the lowered hooked position under the action of the spring 31.

Then the user engages the padded roll 24 with his/her legs to move the actuator 22 to the final raised position (not shown) against the action of the plates 12 of the weight unit 8.

The invention claimed is:

1. A gymnastic apparatus comprising a base (2) used to place the gymnastic apparatus on the ground; an actuator device (14) with at least a user-operated actuator (22) moved from an initial to a final position; a weight unit (8) used to normally maintain the actuator (22) in an initial position; and driving means (33) used to connect the actuator (22) and weight unit (8) and provided with at least a cam (38); characterised in that the base (2) comprises at least a box-shaped section (3); the cam (38) being housed inside the box-shaped section (3) of the base (2); wherein the actuator (22) and cam (38) are fitted to oscillate around a first and a second axis (17, 35), respectively; wherein the actuator device (14) comprises a first shaft (16) coaxial to the first axis (17) and fitted the actuator (22) in a fixed angular position during use, in which the driving means (33) also comprise a second shaft (34) coaxial to the second axis (35) that extends through the box-shaped section (3); the cam (36) being fitted to the second shaft (34).

2. Gymnastic apparatus as defined in claim 1, in which the driving means (33) comprise coupling means (36) of the first and second shaft (16, 34).

3. Gymnastic apparatus as defined in claim 2, in which the coupling means (36) comprise two toothed conical wheels (37) splined to the first and second shaft (16, 34), respectively.

4. Gymnastic apparatus as defined in claim 1, in which the actuator (22) is rotatably fitted to the first shaft (16); a hooking element (27) being provided to block the actuator (22) on the first shaft (16) in the angular position in order to selectively control the initial position.

5. Gymnastic apparatus as defined in claim 4, in which the hooking device (27) comprises at least multiple holes (32) through a bushing (26) distributed around the first axis (17); at least a pin (30) joined to the actuator (22) in angular position and moved from a hooking position, in which the pin (30) engages one of the holes (32), to a release position; elastic thrust means (31) acting on the pin (30) to bias the pin (30) in the hooking position; and actuator means (29) to move the pin (30) to a release position against the action of the elastic thrust means (31).

6. Gymnastic apparatus as defined in claim 5, in which the actuator means (29) consist of a metal tube (29) that extends transversally to the first axis (17) and is joined to the pin (30).

7. A gymnastic apparatus comprising a base (2); an actuator device (14) provided with at least a first shaft (16) with a first determined horizontal axis (17) and at least a user-operated actuator (22) fitted to the first shaft (16) in a fixed annular position during use to oscillate about the first axis (17) from an initial to a final position; a weight unit (8) used to normally maintain the actuator (22) in the initial position; and driving means (33) used to connect the actuator (22) and the weight unit (8), comprising at least a second shaft with a second determined vertical axis (35) and provided with at least a cam (38) joined in angular position to the second shaft (34); the gymnastic apparatus characterised in that the base (2) comprises at least a box-shaped section (3) housing said cam (38) which is splined to the base of the second shaft (34) having a vertical axis while said first shaft (16) is horizontal; the driving means (33) also comprising coupling means (36) provided with two toothed conical wheels (37) joined to each other and splined to the first and the second shaft (16, 34), respectively.

8. Gymnastic apparatus as defined in claim 7, wherein the driving means (33) comprise coupling means (36) of the first and second shaft (16, 34).

* * * * *